US008892238B2

(12) United States Patent
Sweet et al.

(10) Patent No.: US 8,892,238 B2
(45) Date of Patent: Nov. 18, 2014

(54) EDGE BREAK DETAILS AND PROCESSING

(76) Inventors: Edward T. Sweet, San Francisco, CA (US); Roberto Ortega, Cupertino, CA (US); Andrew Davidson, Sunnyvale, CA (US); Simon Lancaster, Gloucester (CA); Thomas Johannessen, Fjerdingby (NO)

( * ) Notice: Subject to any disclaimer, the term of this patent is extended or adjusted under 35 U.S.C. 154(b) by 822 days.

(21) Appl. No.: 12/694,083

(22) Filed: Jan. 26, 2010

(65) Prior Publication Data

US 2011/0081828 A1 Apr. 7, 2011

Related U.S. Application Data

(63) Continuation-in-part of application No. 12/580,934, filed on Oct. 16, 2009.

(60) Provisional application No. 61/249,200, filed on Oct. 6, 2009.

(51) Int. Cl.

| | |
|---|---|
| ***G06F 19/00*** | (2011.01) |
| ***B24B 51/00*** | (2006.01) |
| ***B24B 9/20*** | (2006.01) |
| ***B24B 29/00*** | (2006.01) |
| ***B24B 29/02*** | (2006.01) |

(52) U.S. Cl.

CPC ..... *B24B 9/20* (2013.01); *B24B 29/005* (2013.01); *B24B 29/02* (2013.01); *B24B 51/00* (2013.01)

USPC ..... 700/164; 451/5

(58) Field of Classification Search

USPC ..... 700/164, 170, 172, 175, 176; 451/5, 57, 451/278, 254, 182, 43, 44, 259, 260, 913

See application file for complete search history.

(56) References Cited

U.S. PATENT DOCUMENTS

| | | | |
|---|---|---|---|
| 2,964,887 | A | 12/1960 | Orozco |
| 3,517,466 | A | 6/1970 | Bouvier |

(Continued)

FOREIGN PATENT DOCUMENTS

| | | | |
|---|---|---|---|
| EP | 0 683 026 | B1 | 3/2001 |
| EP | 0 911 717 | B1 | 3/2003 |

(Continued)

OTHER PUBLICATIONS

Block, "MacBook Air Review", http://www.engadget.com/2008/01/25/Macbook-air-review, Jan. 25, 2008.

(Continued)

*Primary Examiner* — Sean Shechtman
*Assistant Examiner* — Steven Garland
(74) *Attorney, Agent, or Firm* — Womble Carlyle Sandridge & Rice LLP

(57) ABSTRACT

A method and an apparatus for shaping an edge at a juncture of two adjoining surfaces of a part. A first surface and a second surface of the part are abraded by contacting a polishing surface of a polishing wheel to the first surface and to the second surface. The polishing surface spins in opposite rotational directions about an axis parallel to the edge when contacting the first and second surfaces respectively. The polishing surface moves at different translational speeds and the polishing wheel spins at different rotational speeds along straight segments and along curved segments of the edge. The shaped edge has a visually smooth and geometrically uniform appearance.

24 Claims, 10 Drawing Sheets

(56) References Cited

U.S. PATENT DOCUMENTS

| | | | | |
|---|---|---|---|---|
| 3,878,650 | A * | 4/1975 | Klotzbach | 451/239 |
| 3,918,209 | A | 11/1975 | Crawley et al. | |
| 3,956,675 | A | 5/1976 | Bauer et al. | |
| 4,643,622 | A * | 2/1987 | Winski | 451/5 |
| 4,744,176 | A * | 5/1988 | Sack et al. | 451/5 |
| 4,766,746 | A | 8/1988 | Henderson et al. | |
| 5,237,486 | A | 8/1993 | LaPointe et al. | |
| 5,315,789 | A | 5/1994 | Takashi | |
| 5,401,348 | A | 3/1995 | Oguchi et al. | |
| 5,419,626 | A | 5/1995 | Crockett | |
| 5,531,950 | A | 7/1996 | Kimura et al. | |
| 5,568,357 | A | 10/1996 | Kochis et al. | |
| 5,606,438 | A | 2/1997 | Margalit et al. | |
| 5,611,517 | A | 3/1997 | Saadi et al. | |
| 5,795,430 | A | 8/1998 | Beeteson et al. | |
| 5,828,341 | A | 10/1998 | Delamater | |
| 5,837,610 | A | 11/1998 | Lee et al. | |
| 5,844,772 | A | 12/1998 | Lee et al. | |
| 5,881,103 | A | 3/1999 | Wong et al. | |
| 5,941,617 | A | 8/1999 | Crane, Jr. et al. | |
| 5,951,379 | A * | 9/1999 | Palmer et al. | 451/182 |
| 5,992,155 | A | 11/1999 | Kobayashi et al. | |
| 6,014,080 | A | 1/2000 | Layson, Jr. | |
| 6,028,765 | A | 2/2000 | Swindler et al. | |
| 6,073,684 | A | 6/2000 | Fiechter et al. | |
| 6,122,167 | A | 9/2000 | Smith et al. | |
| 6,123,606 | A | 9/2000 | Hill et al. | |
| 6,151,012 | A | 11/2000 | Bullister | |
| 6,179,122 | B1 | 1/2001 | Moncrief et al. | |
| 6,248,005 | B1 * | 6/2001 | Ozaki | 451/254 |
| 6,285,449 | B1 | 9/2001 | Ellingson et al. | |
| 6,328,530 | B1 | 12/2001 | Kato et al. | |
| 6,355,332 | B1 | 3/2002 | Kobayashi | |
| 6,358,595 | B1 | 3/2002 | Kobayashi | |
| 6,408,578 | B1 | 6/2002 | Tanaka et al. | |
| 6,532,152 | B1 | 3/2003 | White et al. | |
| 6,542,384 | B1 | 4/2003 | Radu et al. | |
| 6,665,174 | B1 | 12/2003 | Derr et al. | |
| 6,791,465 | B2 | 9/2004 | Blagin et al. | |
| 6,846,228 | B2 | 1/2005 | Lin | |
| 6,853,336 | B2 | 2/2005 | Asano et al. | |
| 6,859,357 | B2 | 2/2005 | Morimoto et al. | |
| 6,859,365 | B2 | 2/2005 | Koiwa et al. | |
| 6,876,543 | B2 | 4/2005 | Mockridge et al. | |
| 6,913,840 | B2 | 7/2005 | Nishikawa et al. | |
| 6,947,282 | B2 | 9/2005 | Hotta et al. | |
| 6,967,833 | B2 | 11/2005 | Boykin et al. | |
| 6,999,826 | B1 | 2/2006 | Zhou et al. | |
| 7,021,112 | B2 | 4/2006 | Nakada | |
| 7,045,220 | B2 | 5/2006 | Ishiduka et al. | |
| 7,167,163 | B2 | 1/2007 | Lu | |
| 7,330,122 | B2 | 2/2008 | Derrick et al. | |
| 7,342,792 | B2 | 3/2008 | Kim et al. | |
| 7,349,203 | B2 | 3/2008 | Jobs et al. | |
| 7,355,849 | B2 | 4/2008 | Ku | |
| 7,369,191 | B2 | 5/2008 | Okamoto et al. | |
| 7,400,499 | B2 | 7/2008 | Mundt et al. | |
| 7,522,889 | B2 | 4/2009 | Wulff et al. | |
| 7,535,547 | B2 | 5/2009 | Tannas, Jr. | |
| 7,545,574 | B2 | 6/2009 | Park et al. | |
| 7,679,893 | B2 | 3/2010 | Lam et al. | |
| 7,729,108 | B2 | 6/2010 | Rehmann et al. | |
| 7,733,635 | B2 | 6/2010 | Sullivan | |
| 7,750,237 | B2 | 7/2010 | Jiang et al. | |
| 7,804,487 | B1 | 9/2010 | Acampora et al. | |
| 7,817,407 | B2 | 10/2010 | Tanaka | |
| 7,817,423 | B2 | 10/2010 | Morehead | |
| 7,855,874 | B2 | 12/2010 | Nakajima et al. | |
| 7,907,400 | B2 | 3/2011 | Bekele | |
| 7,916,487 | B2 | 3/2011 | Bitton et al. | |
| 8,111,505 | B2 | 2/2012 | Raff et al. | |
| 8,125,394 | B2 | 2/2012 | Chiang | |
| 2001/0009498 | A1 | 7/2001 | Oross et al. | |
| 2002/0025862 | A1 | 2/2002 | Sullivan et al. | |
| 2002/0037686 | A1 | 3/2002 | Brown et al. | |
| 2002/0048148 | A1 | 4/2002 | Horiuchi et al. | |
| 2003/0197111 | A1 | 10/2003 | Morimoto et al. | |
| 2004/0027792 | A1 | 2/2004 | Newman | |
| 2004/0048564 | A1 | 3/2004 | Roberts et al. | |
| 2004/0251161 | A1 | 12/2004 | Mueller et al. | |
| 2005/0069667 | A1 | 3/2005 | Wacker | |
| 2006/0056759 | A1 | 3/2006 | Farah | |
| 2006/0082956 | A1 | 4/2006 | Garel et al. | |
| 2006/0252353 | A1 | 11/2006 | Bunce | |
| 2006/0268528 | A1 | 11/2006 | Zadesky et al. | |
| 2007/0019372 | A1 | 1/2007 | Wong et al. | |
| 2007/0019373 | A1 | 1/2007 | Yokote | |
| 2007/0047183 | A1 | 3/2007 | Goto et al. | |
| 2007/0047189 | A1 | 3/2007 | Goto et al. | |
| 2007/0047191 | A1 | 3/2007 | Goto et al. | |
| 2007/0146986 | A1 | 6/2007 | Hong et al. | |
| 2007/0165373 | A1 | 7/2007 | Merz et al. | |
| 2007/0183123 | A1 | 8/2007 | Chuan et al. | |
| 2008/0026614 | A1 | 1/2008 | Emerson et al. | |
| 2008/0237477 | A1 | 10/2008 | Hoggatt et al. | |
| 2008/0239641 | A1 | 10/2008 | Sato et al. | |
| 2008/0316692 | A1 | 12/2008 | Jacobs et al. | |
| 2009/0004952 | A1 | 1/2009 | Takahashi et al. | |
| 2009/0023520 | A1 | 1/2009 | Ninomiya et al. | |
| 2009/0080148 | A1 | 3/2009 | Sugawara | |
| 2009/0088055 | A1 | 4/2009 | Silva et al. | |
| 2009/0146279 | A1 | 6/2009 | Griffin | |
| 2009/0175001 | A1 | 7/2009 | Mathew et al. | |
| 2009/0183819 | A1 | 7/2009 | Matsuhira | |
| 2009/0227394 | A1 | 9/2009 | Bulpett et al. | |
| 2009/0257232 | A1 | 10/2009 | Lam et al. | |
| 2010/0091442 | A1 | 4/2010 | Theobald et al. | |
| 2010/0103611 | A1 | 4/2010 | Yang et al. | |
| 2010/0182746 | A1 | 7/2010 | Lee et al. | |
| 2010/0246119 | A1 | 9/2010 | Collopy et al. | |
| 2010/0259891 | A1 | 10/2010 | Tachikawa | |
| 2011/0090627 | A1 | 4/2011 | Raff et al. | |
| 2012/0030930 | A1 | 2/2012 | Theobald et al. | |

FOREIGN PATENT DOCUMENTS

| | | |
|---|---|---|
| EP | 1 621 967 | 2/2006 |
| JP | 2003-174492 | 6/2003 |
| WO | 9509714 | 4/1995 |
| WO | WO 95/09714 | * 4/1995 |
| WO | WO 2009/126480 | 10/2009 |

OTHER PUBLICATIONS

PowerBook G4 (15-Inch FW 800): Sound Specifications, http://supportapple.com/kb/TA27151?viewlocale=en_US, Jan. 8, 2007.
Gent, A. N. and Hamed, G. R., Adhesion. Encyclopedia of Polymer Science and Technology, (2001) pp. 218-256.
Office Action for U.S. Appl. No. 12/580,934 dated May 10, 2012.
U.S. Appl. No. 12/580,934, filed Oct. 16, 2009.
Final Office Action for U.S. Appl. No. 12/580,934 dated Oct. 5, 2012.
Advisory Action for U.S. Appl. No. 12/580,934 dated Dec. 24, 2012.
China Application No. 201080053846.1—Office Action mailed Apr. 1, 2013.
Korea Application No. 10-2012-7012575—Office Action mailed May 8, 2013.
Mexico Application No. MX/a/2012/004365—Office Action mailed Mar. 25, 2013.
U.S. Appl. No. 12/580,946—Non-Final Office Action mailed Apr. 9, 2012.
U.S. Appl. No. 12/580,946—Final Office Action mailed Aug. 22, 2012.

* cited by examiner

EDGE BREAK DETAILS AND PROCESSING

CROSS REFERENCE TO RELATED APPLICATIONS

This U.S. patent application Ser. No. 12/694,083 entitled "EDGE BREAK DETAILS AND PROCESSING" by Sweet et al. is a continuation-in-part of and claims priority to U.S. patent application Ser. No. 12/580,934 entitled "METHOD AND APPARATUS FOR POLISHING A CURVED EDGE" by Lancaster et al., filed Oct. 16, 2009, which claims the benefit of priority under 35 U.S.C. 119(e) to U.S. Provisional Patent Application Ser. No. 61/249,200 entitled "COMPLEX GEOGRAPHICAL EDGE POLISHING" by Johannessen filed Oct. 6, 2009, both of which are incorporated by reference herein in their entireties for all purposes.

This patent application is related to and incorporates by reference in their entirety the following co-pending patent applications:

U.S. Pat. No. 8,213,168 entitled "ASSEMBLY OF A DISPLAY MODULE" by Ternus et al. filed issued Jul. 3, 2012;

U.S. patent application Ser. No. 12/694,200 entitled "COMPONENT ASSEMBLY" by McClure et al. filed Jan. 26, 2010;

U.S. Pat. No. 8,238,087 entitled "DISPLAY MODULE" by McClure et al. issued Aug. 7, 2012;

U.S. patent application Ser. No. 12/694,166 entitled "PRINTED CIRCUIT BOARD" by McClure et al. filed Jan. 26, 2010; and U.S. patent application Ser. No. 12/694,085 entitled "HANDHELD COMPUTING DEVICE" by Ternus et al. filed Jan. 26, 2010.

TECHNICAL FIELD

The present invention relates generally to the shaping and finishing of an edge of a part. More particularly, a method and an apparatus are described for shaping and finishing the edge of a part to a visually smooth and geometrically uniform appearance.

BACKGROUND OF THE INVENTION

The proliferation of high volume manufactured, portable electronic devices has encouraged innovation in both functional and aesthetic design practices for enclosures that encase such devices. Manufactured devices can include a housing that provides an ergonomic shape and aesthetically pleasing visual appearance desirable to the user of the device. Edge surfaces of housings, for example formed from metal compounds, can be shaped and finished to a desired geometry with a particular visual appearance. The edge surface can reveal minor variations in the final surface geometry or reflective appearance. Prior art techniques can result in a finish with an undesirable variation in geometry and in visually reflective appearance. Thus there exists a need for a method and an apparatus for polishing a curved edge of an object resulting in a geometrically uniform and consistent reflective appearance.

SUMMARY OF THE DESCRIBED EMBODIMENTS

A method for shaping an edge at a juncture of two adjoining surfaces of a part is disclosed. The method can be carried out by at least abrading a first surface of the part along the edge of the part by contacting a polishing surface of a polishing wheel to the first surface positioned at a first angle to the polishing wheel. The method can also include abrading a second surface of the part that adjoins the first surface along the edge of the part by contacting the polishing surface of the polishing wheel to the second surface positioned at a second angle to the polishing wheel. The spinning of the polishing wheel in a second rotational spinning direction can be opposite to the first rotational spinning direction. In an embodiment, the spinning of the polishing wheel can be in a first rotational spinning direction about an axis parallel to the edge of the part.

In an embodiment, the method can further include moving the polishing surface of the polishing wheel along the edge of the part while abrading the first surface at a first translational speed for straight segments of the edge and at a second translational speed for curved segments of the edge. The method can also include moving the polishing surface of the polishing wheel along the edge of the part while abrading the second surface at a third translational speed for straight segments of the edge and at a fourth translational speed for curved segments of the edge. The method can include spinning the polishing wheel while abrading the first surface at a first rotational speed along straight segments of the edge and at a second rotational speed along curved segments of the edge. The method can further include spinning the polishing wheel while abrading the second surface at a third rotational speed along straight segments of the edge and at a fourth rotational speed along curved segments of the edge.

In another embodiment an apparatus for shaping an edge at a juncture of two adjoining surfaces of a part is disclosed. The apparatus can include a polishing wheel comprising a polishing surface. The apparatus can include a fixture configured to stabilize the part and to reveal a limited portion of a first surface adjoining the edge of the part. The apparatus can further include a positioning assembly configured to abrade the first surface of the part along the edge of the part by contacting the polishing surface of the polishing wheel, spinning in a first rotational spinning direction, the first surface positioned at a first angle to the polishing wheel. The positioning assembly can be configured to abrade a second surface of the part that adjoins the first surface along the edge of the part by contacting the polishing surface of the polishing wheel, spinning in a second rotational spinning direction, opposite to the first rotational spinning direction, the second surface positioned at a second angle to the polishing wheel. In an embodiment, the spinning of the polishing wheel can be in a first rotational spinning direction about an axis parallel to the edge of the part.

In a further embodiment, a positioning assembly of an apparatus is disclosed. The positioning assembly of the apparatus can be configured to move the polishing surface of the polishing wheel along the edge of the part while abrading the first surface at a first translational speed for straight segments of the edge and at a second translational speed for curved segments of the edge; and to move the polishing surface of the polishing wheel along the edge of the part while abrading the second surface at a third translational speed for straight segments of the edge and at a fourth translational speed for curved segments of the edge. The positioning assembly can be further configured to spin the polishing wheel while abrading the first surface at a first rotational speed along straight segments of the edge and at a second rotational speed along curved segments of the edge; and to spin the polishing wheel while abrading the second surface at a third rotational speed along straight segments of the edge and at a fourth rotational speed along curved segments of the edge.

In yet another embodiment, a computer readable medium for storing program code executed by a processor for controlling a computer aided manufacturing operation for shaping an edge at a juncture of two adjoining surfaces of a part is disclosed. The computer program code can control abrading a first surface of the part along the edge of the part by contacting a polishing surface of a polishing wheel, spinning in a first rotational spinning direction, the first surface positioned at a first angle to the polishing wheel. The computer program code can also control abrading a second surface of the part that adjoins the first surface along the edge of the part by contacting the polishing surface of the polishing wheel, spinning in a second rotational spinning direction, opposite to the first rotational spinning direction, the second surface positioned at a second angle to the polishing wheel. In an embodiment, the spinning of the polishing wheel can be in a first rotational spinning direction about an axis parallel to the edge of the part.

In a further embodiment, the computer program code can control spinning the polishing wheel while abrading the first surface at a first rotational speed along straight segments of the edge and at a second rotational speed along curved segments of the edge. The computer program code can also control spinning the polishing wheel while abrading the second surface at a third rotational speed along straight segments of the edge and at a fourth rotational speed along curved segments of the edge.

BRIEF DESCRIPTION OF THE DRAWINGS

The invention and the advantages thereof may best be understood by reference to the following description taken in conjunction with the accompanying drawings.

DETAILED DESCRIPTION OF EXAMPLE EMBODIMENTS

The present invention relates generally to the shaping and finishing of a three dimensional curved edge of an object. More particularly, a method and an apparatus are described for shaping and finishing the edge of a casing to a visually smooth and geometrically uniform appearance.

In the following description, numerous specific details are set forth to provide a thorough understanding of the present invention. It will be apparent, however, to one skilled in the art that the present invention may be practiced without some or all of these specific details. In other instances, well known process steps have not been described in detail in order to avoid unnecessarily obscuring the present invention.

High volume manufactured portable electronics devices can include injection molded thermoplastic parts with various geometrically shaped surfaces. Thermoplastic compounds can provide a lightweight moldable material that exhibits desirable properties, such as strength, heat resistance and structural flexibility well suited for casings of portable electronic devices. A representative thermoplastic compound can include PC/ABS (polycarbonate acrylonitrile butadiene styrene) polymer, although other thermoplastic compounds can be used. Both the tactile and visual appearance of a portable electronics device can enhance the desirability of the device to the consumer. A cosmetic outer layer formed from a thermoplastic blend can be polished to a desired reflective appearance while retaining an aesthetically pleasing shape. In some embodiments, a continuously smooth shape having a uniformly visually smooth appearance can be desired.

Prior to post-process finishing, injection molded thermoplastic parts can include surface defects, e.g. parting lines, at seams where individual sections of a mold, in which the thermoplastic molded part is formed, come apart. Parting lines can occur for numerous reasons, e.g. because the edges of two individual sections of the mold cannot perfectly align or because the surface of the mold can become slightly damaged or wear over time during repeated use in high volume manufacturing. The molding process can also require high pressure injection of a thermoplastic compound which can cause slight deviations in the positions of the mold sections. It is desirable to post-process finish the surface of molded thermoplastic parts so that the parting lines cannot be detected tactilely or visually.

Figure 1A:
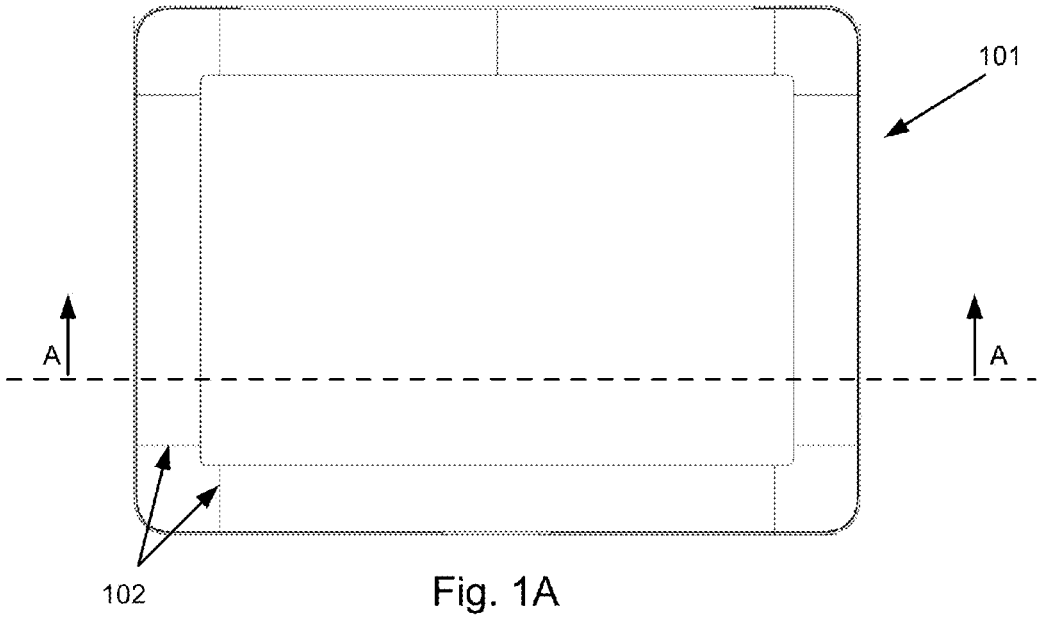
FIG. 1A illustrates a top view of a portable computing device including a molded thermoplastic casing.
Figure 1B:
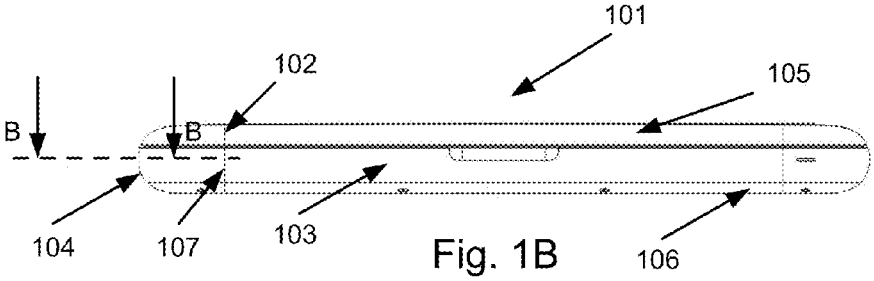
FIG. 1B illustrates a front view of the portable computing device of FIG. 1A.
Figure 2:
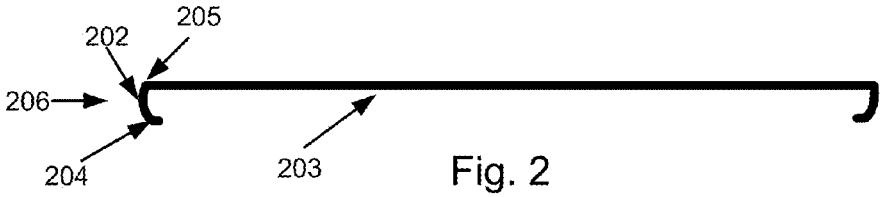
FIG. 2 illustrates a cross section of the molded thermoplastic casing of FIG. 1B including a shaped geometric edge.

FIG. 1A illustrates a top view of a portable electronics device 101 including markings of several possible parting lines 102 on a molded thermoplastic top casing of the portable electronics device 101. FIG. 1B illustrates a front view of the portable electronics device 101 of FIG. 1A including a molded thermoplastic top casing 105, a molded thermoplastic center casing 103 and a base 106. The top casing 105 and the center casing 103 can be formed separately in two different injection molds, each with differently located parting lines in general, even though a parting line 107 of the center casing 103 aligns with the parting line 102 of the top casing 105 as illustrated in FIG. 1B. Each of the parting lines of the center casing 103 can be removed by appropriate polishing. The three-dimensional edge 104 of the center casing can have a specific complex geometric shape that provides an aesthetically pleasing appearance for the portable electronics device 101. FIG. 2 illustrates a cross section 203 of the center casing 103 (along the dashed line and viewed in the direction A in FIG. 1A) including a complex shaped edge 206 (cross section of edge 104 of FIG. 1B). The complex shaped edge 206 can include three distinct regions, a corner region 205 where the side meets the top, an upper region 202 of the side and a lower region 204 of the side. The three different regions 202, 204 and 205 can be finished using one or more different polishing methods. In particular, the corner region 205 can be finished to produce an unsharpened rounded edge using a conventional technique. Such techniques are well known to those skilled in the art. The upper region 202 and the lower region 204 of the complex shaped edge can be finished to achieve a tactilely and visually uniformly smooth reflective surface using a new polishing method as described herein.

Conventional polishing techniques applied to a thermoplastic molded part that includes a complex three-dimensional geometric shape, such as edge 104 of the center casing 103 of FIG. 1B, can result in a visually non-uniform surface, even when the polished surface provides a smooth tactile finish. Highly reflective, glossy polished surfaces can reveal even minute irregularities in surface finish. A visually uniformly smooth, reflective polished surface can be achieved using two stages of polishing, each using different directional movements of one or more polishing wheels. It has been found that shaping the surface of the polishing wheel to mirror the shape of the edge can improve the final resulting surface appearance.

Figure 3A:
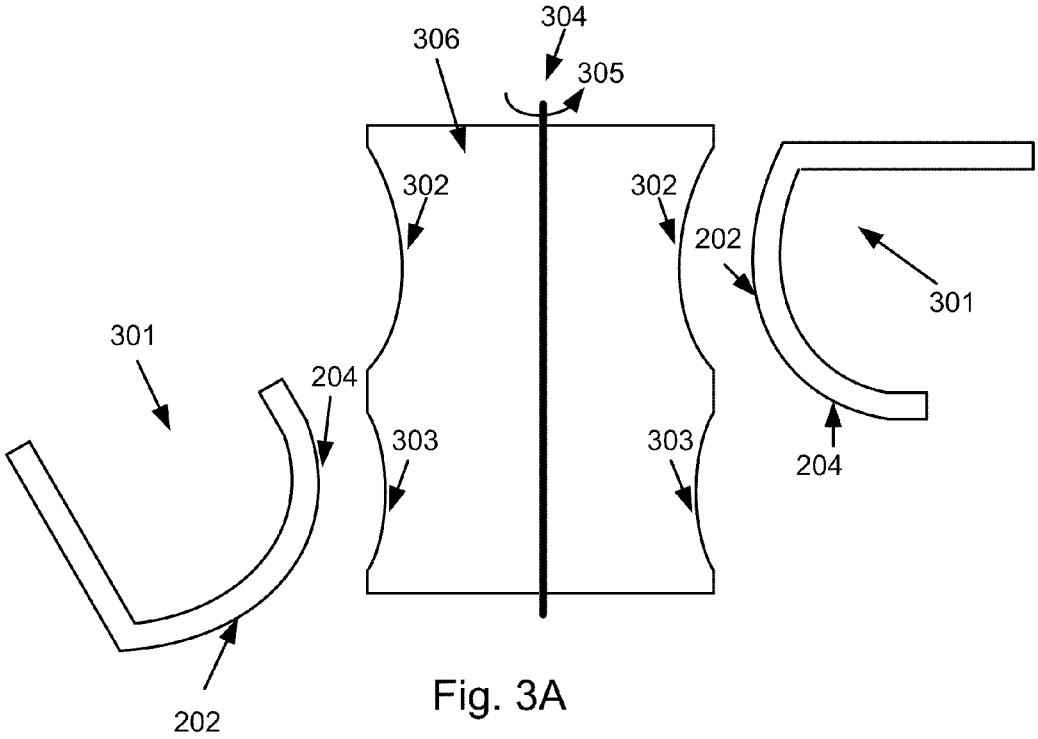
FIG. 3A illustrates a cross section of a polishing wheel with surfaces that conform to the cross section of the molded thermoplastic casing of FIG. 2.

FIG. 3A illustrates a cross section of a polishing wheel 306 having an edge with two abrasive surfaces 302 and 303 that are shaped to match to portions of the complex three dimensional edge 104 of the center casing 103 of FIG. 1B. An end cross section 301 of the three dimensional edge 104 (i.e. an end portion of the cross section edge 206 of FIG. 2) can include a convex upper region 202 and a convex lower region 204. The concave surface 302 of the polishing wheel 306 can match to the convex upper region 202 of the edge 301, while the concave surface 303 of the polishing wheel 306 can match to the convex lower region 204 of the edge 301. Depending on the geometry of a complex three-dimensional edge, a surface can be polished using one or more surfaces of a polishing wheel, where each surface can polish a different region of an edge. Lower curvature edges can use one polishing surface of the polishing wheel 306, while higher curvature edges can use two or more polishing surfaces of the polishing wheel 306.

In a representative embodiment, the polishing wheel 306 can be turned in a rotational direction 305 along a longitudinal axis of the edge 301 that it polishes. To align each of the surfaces of the edge 301 of the center casing 103 to a surface of the polishing wheel 306, either the polishing wheel 306 or the center casing 103 can be positioned appropriately in an assembly fixture. In an embodiment, the center casing 103 can be fixed on a stand, while the polishing wheel 306 can be moved along one or more axes in three dimensions and tilted at an angle to align a surface of the polishing wheel 306 to a portion of an edge of the center casing 103. The position and rotational velocity of the polishing wheel 306 can be controlled by a computer to maintain a desired position and consistent speed when contacting a surface of the center casing 103.

Figure 3B:
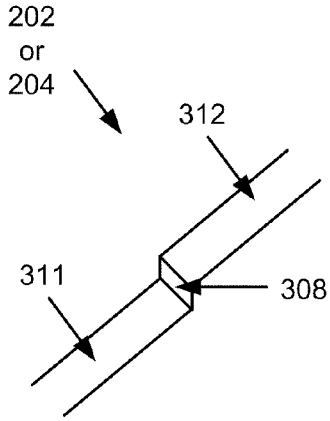
FIG. 3B illustrates a magnified view of a surface defect on the shaped geometric edge of the thermoplastic casing of FIG. 2.

Both the upper region 202 and the lower region 204 of the center casing 103, formed of an injection molded thermoplastic compound, can contain surface defects along boundaries where separate portions of a mold in which the center casing 103 can be formed come apart. As shown in FIG. 3B, a surface defect 308 can include a change in vertical displacement approximately perpendicular to the surface edge. A surface defect can be at least 10 microns high and typically can be approximately 20 microns high. This relatively small displacement can be visible as a discrete line surface defect 308 across the edge of the molded center casing 103 as shown by a side view 401 in FIG. 4A. To remove the discrete line surface defect 308 from the edge of the molded center casing 103, a two stage polishing method can be used, a first abrading stage to eliminate the vertical displacement and a second polishing stage to remove any residual visible variation in surface reflectance along the edge of the center casing 103. Surface defects up to approximately 30 microns high can be removed using the two stage polishing method described herein.

Figure 3C:
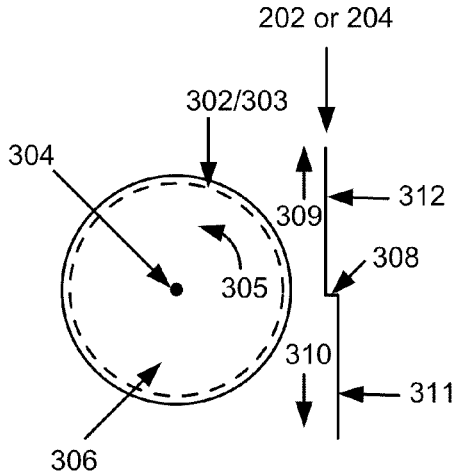
FIG. 3C illustrates a top view of the polishing wheel and two directions of movement of the polishing wheel relative to the surface defect on the shaped geometric edge of the thermoplastic casing of FIG. 2.

As illustrated by FIG. 3C, the polishing wheel 306 can be turned in a rotational direction 305 about a central rotational axis 304 and moved longitudinally in two directions 309 and 310 along regions 202 or 204 of the edge 206 of the molded part when polishing their surfaces. For clarity, FIG. 3C is shown as a two-dimensional cross section of a three-dimensional surface with the polishing wheel moving along one axis. It should be understood that the polishing wheel 306 also can be positioned along the two other axes perpendicular to the directions 309/310 shown, as well as tilted as needed to match a surface of the polishing wheel 306 to the edge 104. The three-dimensional edge 104 may be curved, and the polishing wheel 306 may be positioned to follow along the three-dimensional edge 104 when polishing.

We will describe polishing the upper region 202 of the edge cross section 301; however the same method described can apply to polishing the lower region 204. In the first abrading stage of polishing the upper region 202, the surface defect 308 can be reduced in height by contacting the rotationally spinning polishing wheel 306 along the direction 309 that points into the face of the surface defect 308. The rotating polishing wheel 306 can contact the upper region 202 at a portion of the surface 311 below the surface defect 308 and traverse longitudinally along the edge into the face of the surface defect 308 and then along a portion of the surface 312 above the surface defect 308. Contacting the surface repeatedly can abrade the surface defect 308 to remove the change in vertical displacement thereby producing an even surface.

The rotating polishing wheel can be moved laterally to sever contact with the portion of the surface 312 and reoriented to start the wheel at the portion of the surface 311 below the surface defect 308 for each successive pass during the first abrading stage of polishing. By removing the surface defect 308 uni-directionally during the first abrading stage of polishing rather than bi-directionally, as can be used conventionally, the surface of the edge can be polished in the second stage to achieve a desired visually uniformly smooth appearance. In the second polishing stage of polishing, the rotating polishing wheel 306 can contact the surface of the edge bi-directionally in both the first direction 309 and a second direction 310 longitudinally along the edge. In some embodiments a second rotating polishing wheel can be used have a finer abrasive surface than the coarser abrasive surface of the first rotating polishing wheel 306 used to abrade the surface defect. The second polishing wheel can be similarly shaped to match geometrically to the portion of the edge to which it would contact. The first polishing wheel 306 can be used to produce a first smoothness on the surface, while the second polishing wheel can be used to produce a second finer smoothness on the surface. The surface having a first smoothness can be tactilely smooth but visually non-uniform, while the second surface having a finer smoothness can be additionally visually uniformly smooth in appearance.

Figure 3D:
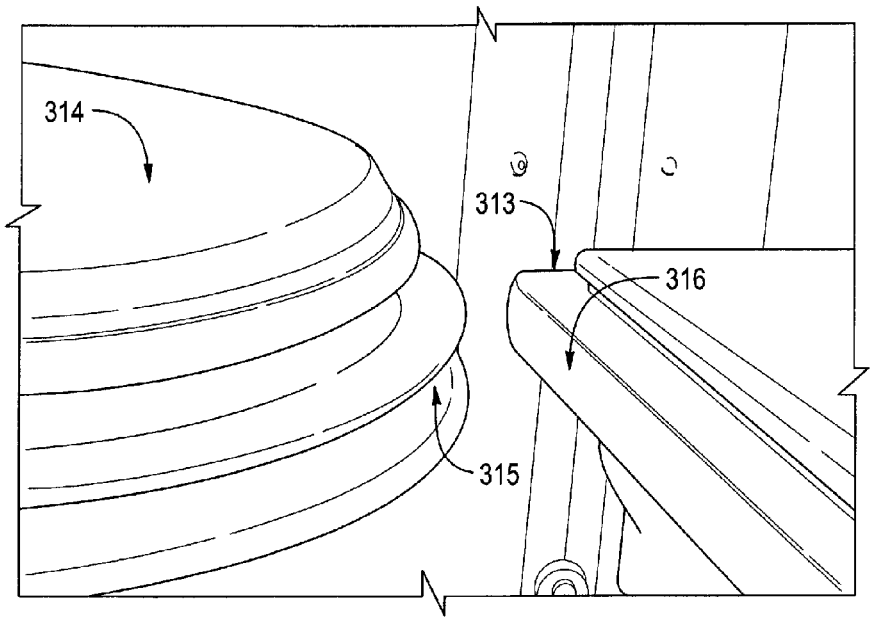
FIG. 3D illustrates a representative embodiment of a polishing wheel including two surfaces and a representative embodiment of a molded thermoplastic casing including a shaped geometric edge.
Figure 3E:
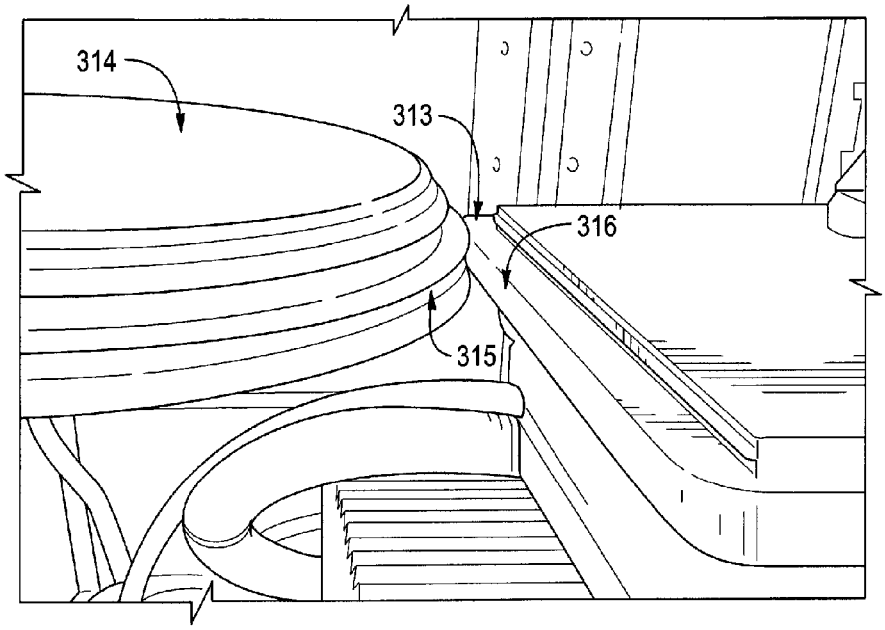
FIG. 3E illustrates the polishing wheel and the thermoplastic casing of FIG. 3D with one of the surfaces of the polishing wheel in contact with the thermoplastic casing.

FIG. 3D illustrates a representative embodiment of a polishing wheel 314 including a concave surface 315 that conforms to the convex shape of a portion of the surface of the complex geometric edge 316 on a representative embodiment of a thermoplastic casing 313 for a portable computing device. FIG. 3E illustrates the concave surface 315 of the polishing wheel 314 contacting the portion of the surface of the complex geometric edge 316 of the thermoplastic casing 313. The polishing wheel 314 can move laterally along the edge 316 when abrading or polishing the surface of the edge 316 of the thermoplastic casing 313. The polishing wheel 314 of FIG. 3D can correspond to an embodiment of the polishing wheel 306 of FIG. 3A including the concave surface 315 corresponding to an embodiment of the convex surface 302. Similarly the complex geometric edge 316 of the thermoplastic casing 313 can correspond to an embodiment of the portion of the surface 202 that conforms to the surface of the polishing wheel.

Figure 4A:
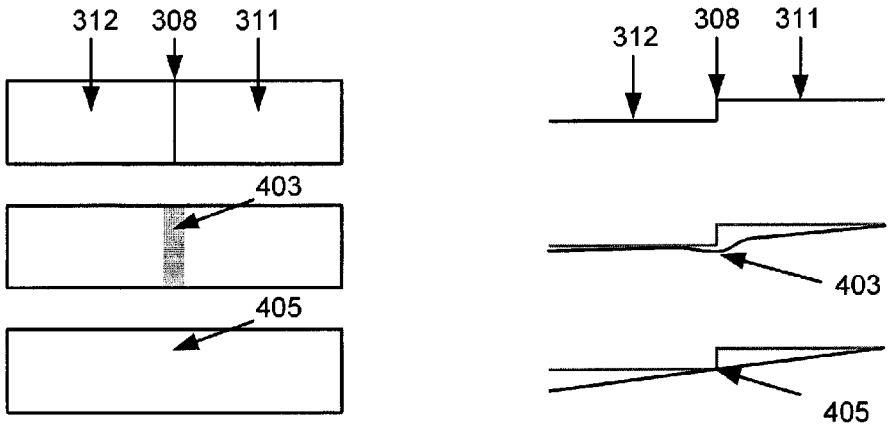
FIG. 4A illustrates three front and side views of the surface of the shaped geometric edge of the thermoplastic casing of FIG. 2 with different polishing results.

FIG. 4A illustrates two different surface appearances that can result when polishing a complex geometrically shaped edge to remove a surface defect 308. A uniform surface appearance 405 with no visible variations can result when using the method described above. A non-uniform surface appearance 403 can result when using a polishing method that abrades the surface bi-directionally during the first stage rather than uni-directionally as described herein, even when followed by a bi-directional polishing during the second stage. By abrading the surface defect 308 in one direction only during the first stage of polishing, the resulting polished surface edge can change height approximately linearly with a uniform surface appearance 405, while abrading the surface bi-directionally can result in a polished surface edge having a "dip" resulting in a visually non-uniform appearance 403.

Figure 4B:
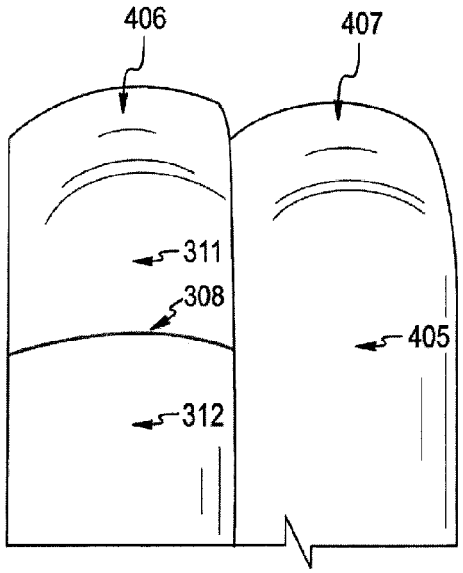
FIG. 4B illustrates a surface defect on an edge of an unpolished thermoplastic casing and a second thermoplastic casing including a polished edge with a surface defect removed.
Figure 4C:
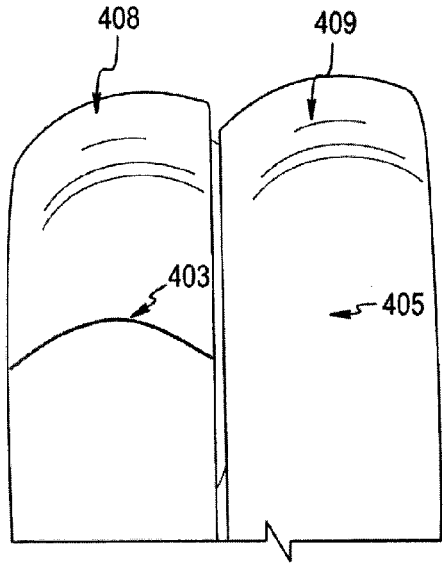
FIG. 4C illustrates two thermoplastic casings including polished edges using two different polishing methods.

FIG. 4B illustrates the surface defect 308 on a surface edge of a first thermoplastic casing 406 which can be visible before polishing and can be visually uniformly smooth after polishing as shown by the surface 405 on the second thermoplastic casing 407. FIG. 4C illustrates a third thermoplastic casing 408 with a surface of a geometric edge abraded and polished bi-directionally resulting in a visually non-uniform surface 403. While the visually non-uniform surface 403 on the thermoplastic casing 408 may be tactilely smooth, the non-uniform surface 403 reflects light irregularly. Using the method described herein instead to abrade the surface uni-directionally followed by polishing the surface bi-directionally, the surface defect 308 of a fourth thermoplastic casing 409 is completely removed providing a visually uniformly smooth surface 405 as illustrated in FIG. 4C.

One embodiment of the polishing method described herein can use two different polishing wheels to remove a surface defect on a complex geometric shaped edge, one polishing wheel to abrade the surface and a second polishing wheel to polish the surface. The polishing wheels can include multiple surfaces, each shaped to conform to a different portion of the surface of the complex geometric shaped edge to be polished. The use of two polishing wheels in the embodiment is not intended to limit the invention. The number of polishing wheels and the number of surfaces on each polishing wheel can vary based on the size of the defect and the complex geometric shape of the edge to be polished. More complex geometric shaped edges can use one or more surfaces on one or more wheels. In some embodiments a single polishing wheel can be used, such as when the surface defect is less than 15 microns in height.

In high volume manufacturing it is also desired to provide consistency between multiple parts even as the polishing surfaces 302 and 303 of the polishing wheel 306 can change with repeated use (and the unpolished edges of different molded parts can vary as well). The polishing wheel can be connected to a controller that measures the rotational velocity (in terms of revolutions per minute, or RPM) of the polishing wheel and maintains the rotational velocity within a specified range when contacting the surface of the molded part by controlling the exact position of the rotational axis 304 of the polishing wheel in three dimensions with respect to the molded part. The angular tilt of the polishing wheel can also be controlled. By controlling the polishing to use a constant rotational velocity even as the abrasive surfaces of the polishing wheel change shape can provide consistency in the resulting surface appearance of the polished molded part.

It should be noted that RPM can be set according to material type. For example, for example, blends of poly-carbonate (PC) and acrylonitrile butadiene styrene (ABS), or PC/ABS, has a lower melting point than PC alone and thus RPM should be reduced to lower the chance of overheating and damaging the unit. Otherwise a cooling system can be used such as a cooled holding fixture or air conditioning.

High volume manufactured portable electronics devices can include multi-dimensionally formed metal compound parts with various geometrically shaped surfaces. Forming an initial shape of the metal compound part can be accomplished using any number of known techniques including multi-dimensional stamping, bending and folding of sheet metal. Metal compounds, such as aluminum, can provide a lightweight material that exhibits structural rigidity and heat dissipation properties suitable for a housing of portable electronics devices. Just as with devices that use molded thermoplastic compounds, the tactile and visual appearance of the portable electronics device can enhance the consumer's experience in using the device. In some embodiments, a shape having a tactile surface without rough or sharp edges and also a visually smooth and geometrically uniform appearance can be desired.

Figure 5A:
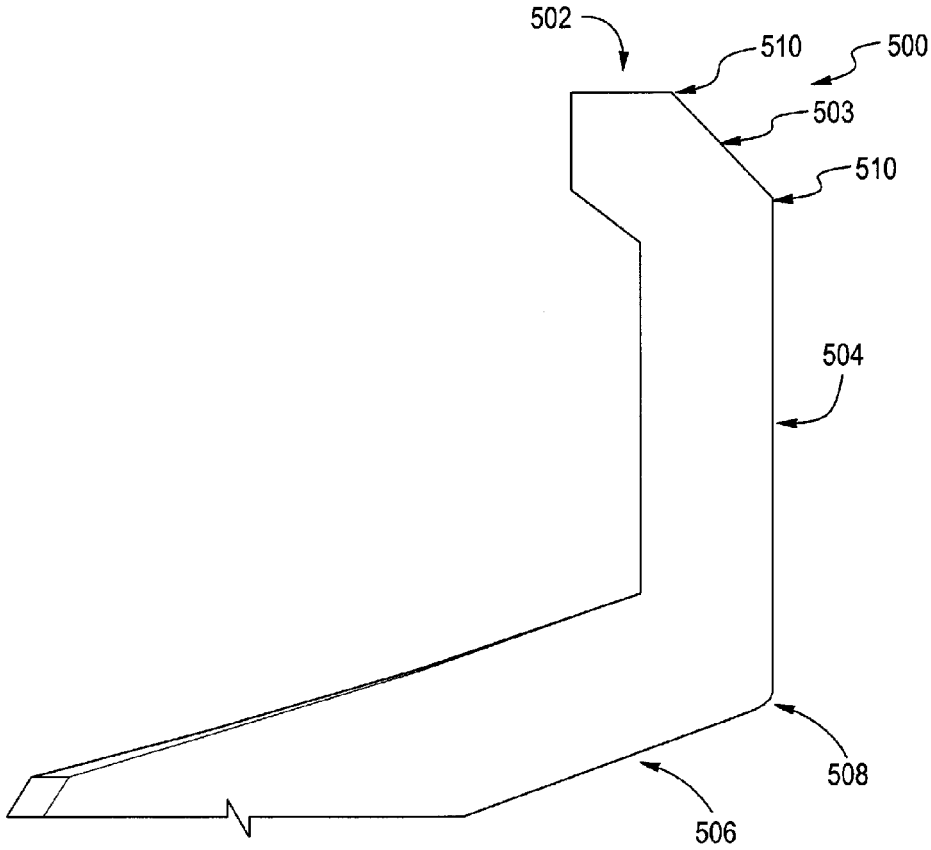
FIG. 5A illustrates a cross sectional view of a portion of a housing having a shaped edge.
Figure 5B:
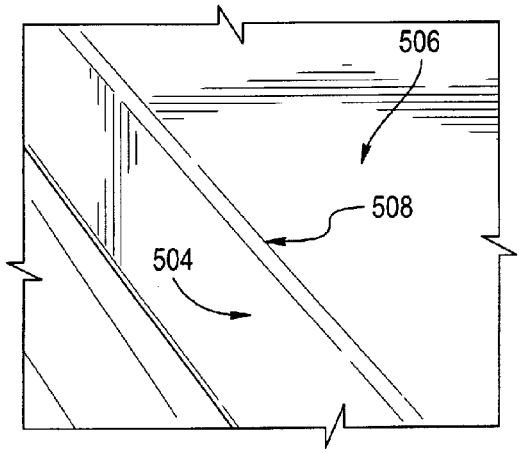
FIG. 5B illustrates a close-up perspective view of the bottom and side of the housing of FIG. 5A having the shaped edge.

Formed metal compound parts can include multiple edges, and each edge can be shaped to different profile geometries. FIG. 5A illustrates a cross-section 500 through a representational housing that can include several different edges at joins between different planar or curved surfaces. A horizontal flat top surface 502 can abut a flat angled surface 503 that can adjoin a flat side surface 504; each join between surfaces can have relatively sharp (narrow radius) edges 510. These relatively sharp edges 510 can be finished in post processing by reducing the edges 510 to a duller but still "hard", i.e. relatively narrow radius, edge 510. These "hard" edges can be appropriate for the top surface of a device, providing a visually distinctive appearance, but can prove less desirable for a bottom surface of the device that can be in contact with the user's hands when operating the device. It can be preferred to have a "softer", i.e. relatively wider radius, edge on select portions of the housing so that the device can be comfortable to hold. A bottom surface 506 of the housing can meet the side surface 504 at a second edge 508, which can be finished in post-processing to a round radius within a particular range of values. In an embodiment, the radius of the edge can be kept to within a strictly limited range of values around the entire perimeter of the housing, including both straight segments and curved segments, thereby providing a geometrically uniform appearance. FIG. 5B illustrates a close-up view of a representative embodiment of a portion of a housing having the bottom surface 506 adjoining the side surface 504 at the rounded edge 508. The representative embodiment shown in FIG. 5B can have a radius of 0.2 mm, for example, with a variation strictly controlled within a narrow range of +/−0.05 mm. As shown, the de-sharpened edge 508 can provide a visually smooth and geometrically uniform highlight along the edge 508.

Polishing wheels, such as "de-burring" brushes, can be used to abrade the surface of a formed metal compound part. A spinning de-burring brush wheel can be used to remove small burrs, to form specific edge-radius details and to improve the surface finish on the formed metal compound part. An exemplary type of de-burring brush wheel can be constructed from nylon filaments embedded with abrasive material. Unlike a grinding wheel coated on a surface with an abrasive material, nylon abrasive filament brushes wear during use, constantly exposing new abrasive grains as the nylon abrasive filaments contact the metal surface being finished. Thus a nylon abrasive filament brush can provide uniform abrasion as the brush surface wears in use across many parts in a high volume manufacturing environment.

Figure 6A:
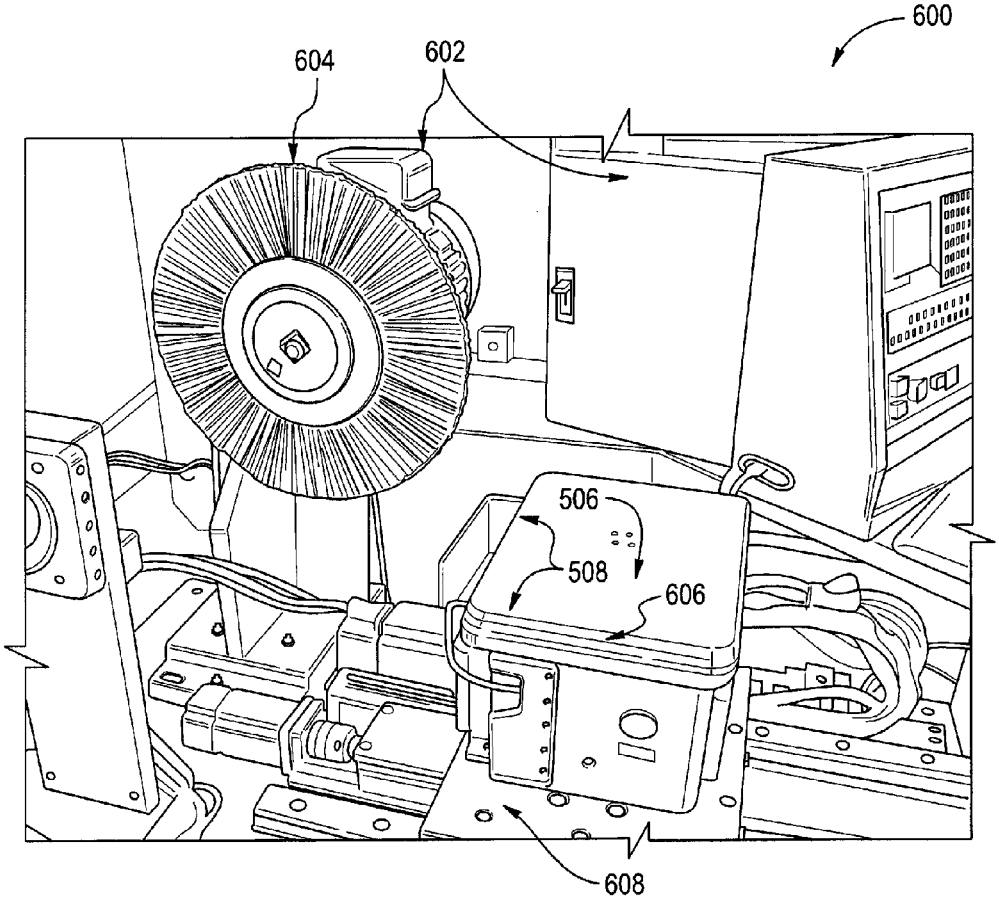
FIG. 6A illustrates a manufacturing assembly for shaping an edge of the housing of FIG. 5A.

FIG. 6A illustrates a manufacturing apparatus 600 including a computer numerically controlled (CNC) multiple axis polishing machine 602 that can move the edge 508 of a metal housing along a direction perpendicular to a spinning nylon abrasive filament brush wheel 604. The housing can be positioned in a holding fixture 608 with the bottom surface 506 of the housing facing outward and the side surfaces of the housing can be partially blocked by sidewalls 606 of the holding fixture 608. The CNC polishing machine 602 can be programmed to control the rotational speed of the brush wheel 604, the position of the edge 508 with respect to the spinning edge of the brush wheel 604, and the speed of movement of the edge 508 through the brush wheel 604.

Figure 6B:
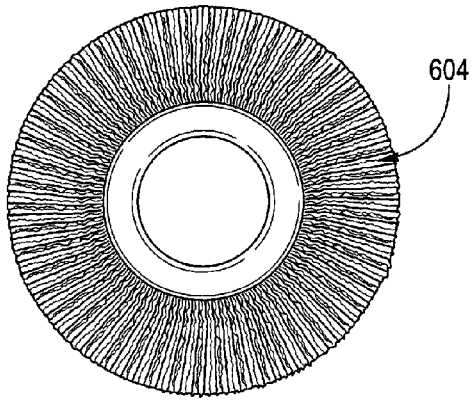
FIG. 6B illustrates a polishing wheel for use in the manufacturing assembly of FIG. 6A.

FIG. 6B illustrates a representative brush wheel 604 constructed with multiple nylon abrasive filaments made of nylon impregnated with an abrasive material. Brush wheels that can be used for de-burring and edge breaking can be constructed in different sizes and with different levels of abrasive "grit" material within the nylon filaments. The coarseness of the grit can be chosen to allow quick removal of surface material while still assuring a smooth and uniform surface finish for the metal housing after final post-processing. For a metal housing made of aluminum, a polishing wheel using a silicon carbide abrasive can be used.

The CNC polishing machine 602 can be programmed to shape and finish an edge of a formed metal housing at least two separate passes of the metal housing through the polishing wheel 604, each pass using different operational parameter settings. Two passes can be used to create a radial edge profile that is tangential to both surfaces that join at the edge. As the polishing wheel 604 follows the perimeter of the housing, for example around a corner between two perpendicular edges, the polishing wheel's rotational speed, as well as the translational speed of the housing movement relative to the spinning polishing wheel 604, and the position of the polishing wheel 604 relative to the housing can be varied to achieve a visually smooth and geometrically uniform edge.

Figure 7A:
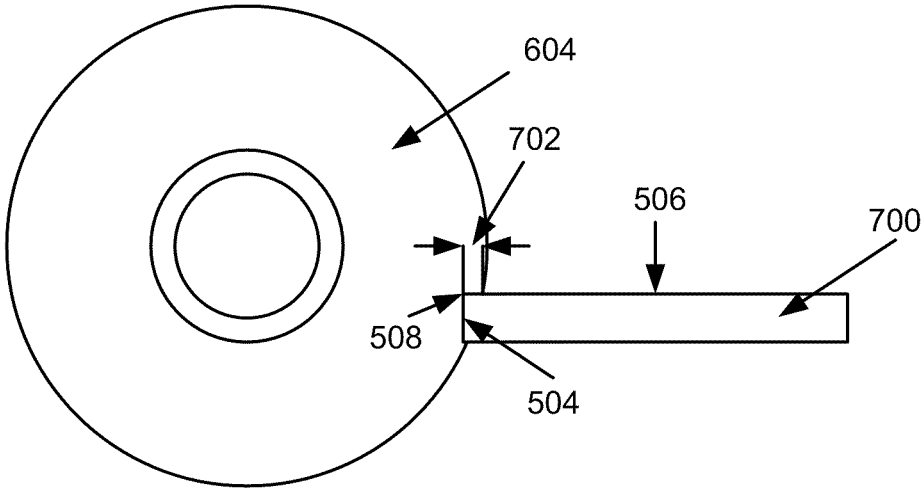
FIGS. 7A, 7B, 7C, 7D illustrate simplified side views of a polishing wheel positioned to shape an edge of a housing.
Figure 7B:
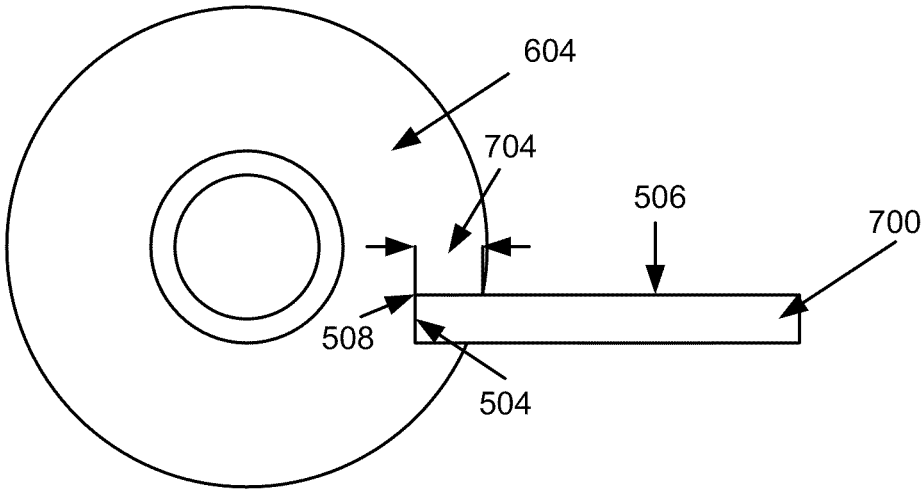

An advantage of using nylon abrasive filament polishing wheels, compared against other forms of de-burring and edge breaking wheels, is a high degree of compliance. Nylon abrasive filament polishing wheels can be designed to be used with a relatively high depth of interference, for example a depth of 10% of the nylon abrasive filament's length. Thus, slight variations in metal housing size and/or alignment between the metal housing and the polishing wheel can insignificantly affect the finished edge geometry. FIG. 7A illustrates a metal housing 700 inserted at a relatively low depth of interference 702 into nylon abrasive filaments of the polishing wheel 604, while FIG. 7B illustrates the metal housing 700 inserted at a relatively high depth of interference 704.

Several operational parameters of the CNC polishing machine 602 can be varied while shaping and polishing the edge 508 of the formed metal housing 700. These operational parameters can include a polishing wheel rotational speed (rpm), a translational speed (mm/min) of the formed metal housing 700 with respect to the rotating polishing wheel 604, a depth of interference (mm) and a position of the polishing wheel 604 relative to the edge 508 of the formed metal housing 700 (measured as an angular "clock" position or equivalently a translational z height). To create a geometrically uniform radius edge 508 around the perimeter of the formed metal housing 700, different operational parameters can be used when shaping and polishing corner sections of the edge 508 where two straight side sections join and along the straight side sections of the edge 508. Similarly for a formed metal housing having an irregularly shaped edge (for example an irregularly curved edge) the parameters can be varied at multiple points along the edge when shaping and polishing the edge to provide a geometrically uniform cross-section. Different rotational speeds of the polishing wheel 604 and different translational speeds of the polishing wheel 604 with respect to the formed metal housing edge 508 can be used when rotating the polishing wheel 604 in one direction versus rotating the polishing wheel 604 in an opposite direction. These different operational parameters can also depend on characteristics of a particular manufacturing station having specific polishing wheels and also depend on variations in geometry of formed metal housings being polished. Thus an acceptable range of operational settings can be determined for a set of machine parameters that can account for manufacturing station and formed metal housing variability.

Higher polishing wheel rotational speeds can cause the de-sharpening shaping process to be more aggressive. Excessive rotational speeds, for example 3500 rpm or greater, can result in uneven shaping and finishing results as the nylon abrasive filaments can "bounce" off the edge of the formed metal housing 700 rather than brushing against it. Also at higher rotational speeds, the nylon abrasive filaments can heat up causing them to melt and smear. In an embodiment, the rotational speed used for the polishing wheel 604 along straight segments of an edge can be approximately twice the rotational speed used along corner segments at a boundary where an edge changes direction.

Slower translational speeds can also cause the de-sharpening shaping process to be more aggressive. However, nylon abrasive filament brushes can be self-limiting to a certain extent so that there can be diminishing returns at very slow translational speeds. Increasing the depth of interference can also cause the de-sharpening shaping process to be more aggressive, but as with very slow translational speeds, an increased depth of interference can also not substantially change the "aggressiveness" of the shaping and polishing de-sharpening process. At higher depth of interference, an amount of motor torque and power required to rotate the polishing wheel can also become an issue.

Figure 7C:
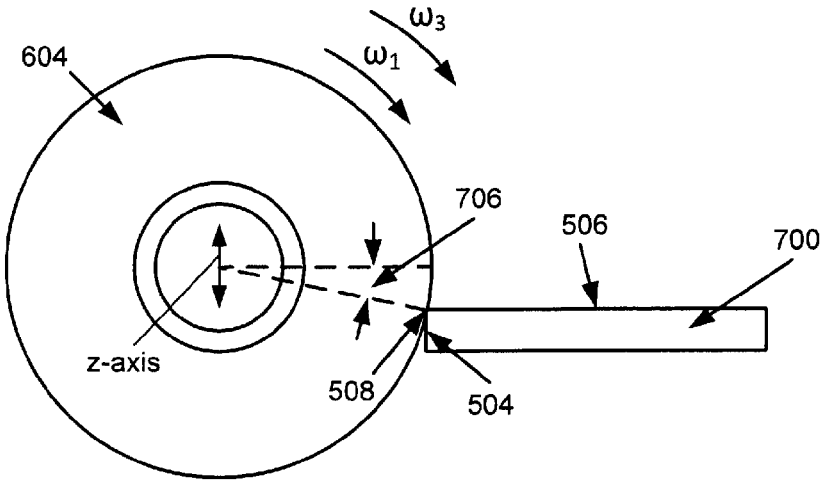
Figure 7D:
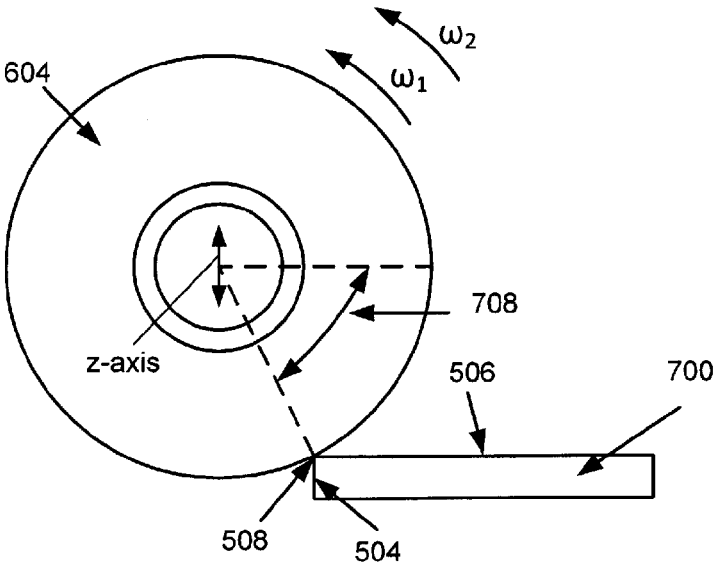

As shown in FIGS. 7C and 7D, the nylon abrasive filament polishing wheel 604 can be positioned relative to the formed metal housing 700 at a different angle for each translational movement pass of the formed metal housing 700 relative to the polishing wheel 604. As shown in FIG. 7C, during a "down" pass (clockwise rotation), the polishing wheel 604 can be positioned at a relatively shallow angle 706 from a horizontal line through the center of the polishing wheel 604. The angle position 706 shown in FIG. 7C can be referred to as approximately a "3:30" clocking position at which the nylon abrasive filaments of the polishing wheel 604 touch the edge 508 of the formed metal housing 700. For the position shown in FIG. 7C, a radius tangential to the side wall 504 of the housing can be shaped along the edge 508. FIG. 7D illustrates the formed metal housing 700 positioned at approximately a "5:00" clocking position (angle 708) against the nylon abrasive filaments of the polishing wheel 604 during an "up" pass (counter-clockwise rotation). For this position, a radius tangential to the top surface 506 of the metal housing 700 can be shaped along the edge 508. Changes in clocking position can be effected by changing the z-position of the polishing wheel 604 relative to the formed metal housing 700. Along a corner of the edge 508 of the formed metal housing 700, the polishing wheel 604 can be changed in position along the z-axis relative to the z-axis position used when shaping and polishing along straight portions of the edge 508 to ensure a consistent radius cross-section is shaped and polished into the edge 508 by the nylon abrasive filament polishing wheel 604. Moving the polishing wheel 604 relative to the formed metal housing 700 can change both the angular clocking position and the depth of interference. In a representative embodiment, the polishing wheel 604 can be moved along at least three translational axes of movement relative to the formed metal housing 700.

Figure 7E:
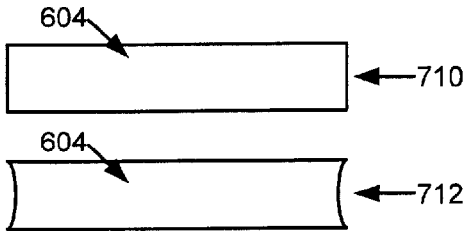
FIG. 7E illustrates a top view of the polishing wheel before and after shaping a number of housings.

As shown in FIG. 7E, a top view of the polishing wheel 604 can have straight edges 710 when newly used in the manufacturing station and have curved edges 712 after shaping and polishing a number of metal housings. As the shape of the edge of the polishing wheel 604 can affect the resulting radius in the shaped edge of the formed metal housing 700, the polishing wheel 604 can be replaced after a number of formed metal housings 700 are shaped and polished. In one embodiment, the polishing wheel 604 can be changed after the edges of formed metal housings 700 are shaped and polished. Alternatively parameter settings for the CNC polishing machine 602 can be adapted to account for the change in shape of the edge of the polishing wheel 604 to ensure a visually smooth and geometrically uniform resulting edge on the formed metal housing 700.

A representative embodiment can use the following range of parameters to control the CNC polishing machine 602 having a 300 mm polishing wheel 604 including 2800 nylon abrasive filaments per wheel and 240 grit abrasive embedded therein. During the "up" shaping and polishing along straight segments of the edge of the formed metal housing 700, a rotational speed ($\omega_1$) having a range of 750 to 1250 rpm can be used with a translational speed having a range of 900 to 1500 mm/min and a depth of interference having a range of 3 to 6.25 mm. During the "up" shaping and polishing of curved corner segments 508 of the edge, where two straight segments 504 and 506 of the edge meet, a rotational speed ($\omega_2$) having a range of 450 to 1000 rpm can be used with a translational speed having a range of 3200 mm/min and a depth of interference having a range of 3 to 6.25 mm. During the "down" shaping and polishing along straight segments of the edge, a rotational speed ($\omega_1$) having a range of 750 to 1250 rpm can be used with a translational speed having a range of 2000 to 2400 mm/min and a depth of interference of 3 to 6.25 mm. During the "down" shaping and polishing of curved corner segments 508, a rotational speed ($\omega_3$) having a range of 375 to 625 rpm can be used with a translational speed of 3200 mm/min and a depth of interference of 3 to 6.25 mm. Higher translational speeds can be used in conjunction with higher values of depth of interference, while lower translational speeds can be used together with lower values of depth of interference. A 5:00 angular clocking height can be used during the "up" shaping and polishing and can correspond to a z height of 40 mm. A 3:30 angular clocking height can be used during the "down" shaping and polishing and can correspond to a z height of −25 mm and −30 mm for the curved corner 508 and straight segments 504 and 506 respectively. Carefully controlling the operational parameters as the polishing wheel 604 passes across the straight 504 and 506 and curved corner 508 segments on the edge of the formed metal housing 700 can ensure a visually smooth and geometrically resulting edge.

Figure 8A:
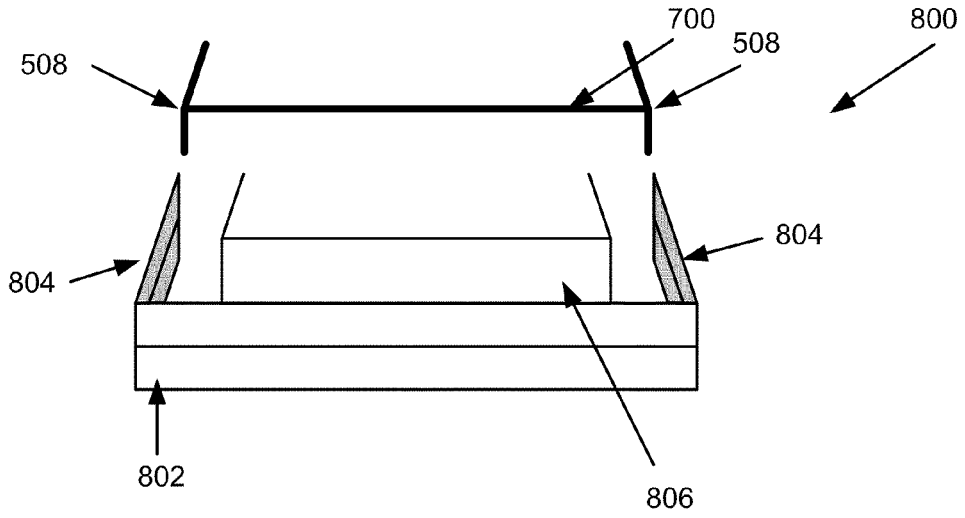
FIGS. 8A, 8B illustrate simplified perspective views of a manufacturing fixture to hold a housing while shaping an edge.
Figure 8B:
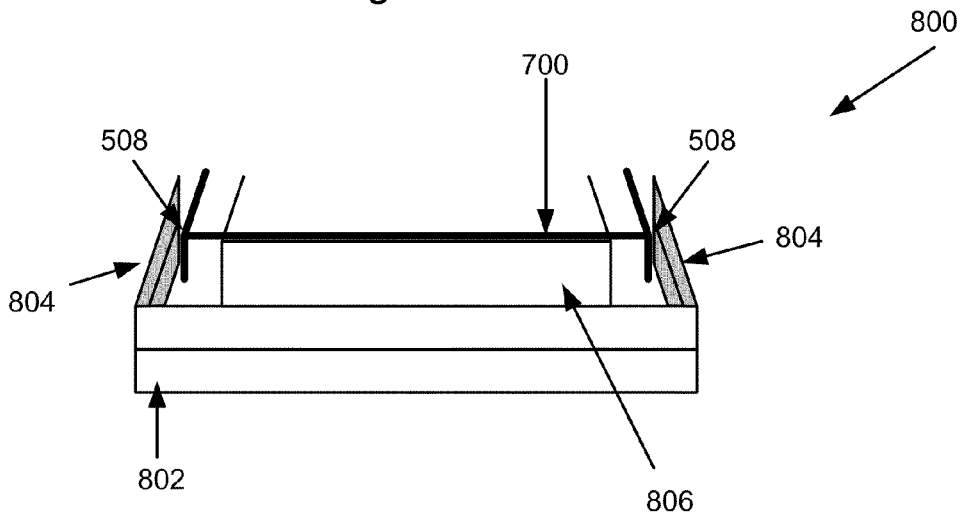
Figure 8C:
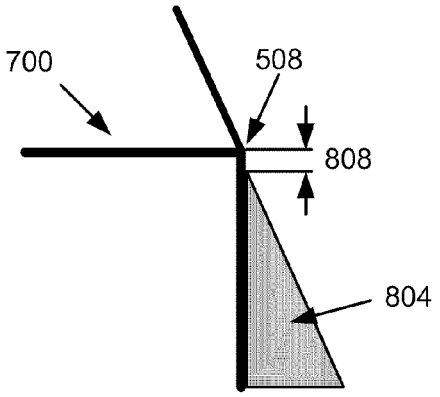
FIG. 8C illustrates a simplified perspective view of the housing with respect to side walls of the manufacturing fixture.
Figure 8D:
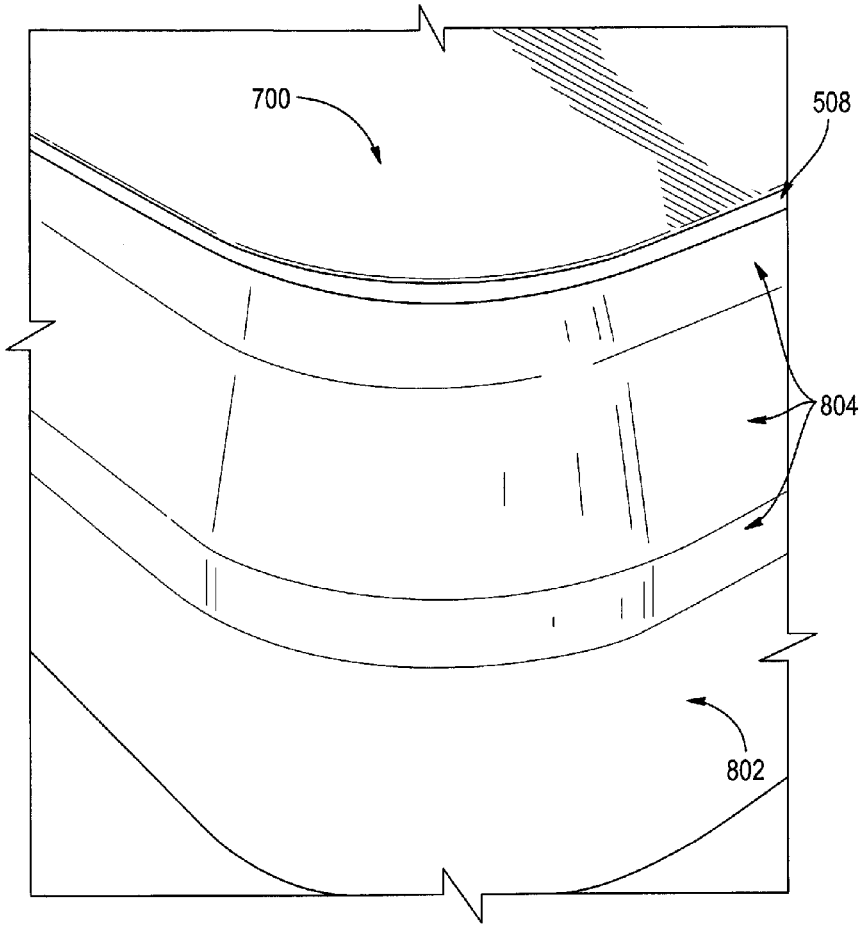
FIG. 8D illustrates a representative housing positioned in a manufacturing fixture for shaping an edge.

FIGS. 8A-C illustrate a simplified view of a manufacturing fixture 800 that can protect sidewalls of the formed metal housing 700 when shaping and polishing the edges 508. As shown in FIGS. 8A and 8B, a vacuum buck 806 can hold the formed metal housing 700 in place within the manufacturing fixture 800, which can include a base plate 802 underneath a fixture sidewall 804. FIG. 8D shows a photograph of a representative embodiment of the fixture sidewall 804 atop the fixture base plate 802 with the edge 508 to be shaped and polished on the formed metal housing 700 abutting the fixture sidewall 804. A vertical offset 808, as illustrated in FIG. 8C, between the top of the fixture sidewall 804 and the edge 508 to be shaped and polished can be adjusted to an appropriate height to minimize the frequency with which the fixture sidewall 804 need be replaced. (The nylon abrasive filaments of the polishing wheel can abrade a fixture sidewall which can also be formed from metal.) The fixture sidewalls can be replaced when their height wears by a pre-determined distance.

The various aspects, embodiments, implementations or features of the described embodiments can be used separately or in any combination. Various aspects of the described embodiments can be implemented by software, hardware or a combination of hardware and software. The described embodiments can also be embodied as computer program code on a computer readable medium for controlling a computer aided manufacturing operation. The computer readable medium is any data storage device that can store data which can thereafter be read by a computer system. Examples of the computer readable medium include read-only memory, random-access memory, CD-ROMs, DVDs, magnetic tape and optical data storage devices. The computer readable medium can also be distributed over network-coupled computer systems so that the computer program code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated.

It is intended that the scope of the invention be defined by the following claims and their equivalents.

What is claimed is:

1. A method for smoothing an edge of a part, the edge defined by a first planar surface and a second planar surface, the method comprising:

operating a rotating polishing wheel comprising a polishing surface in accordance with a first set of polishing parameters to form a first curved surface at the edge and the first planar surface, the first set of polishing parameters comprising a first set of rotational speeds, a first set of translational speeds and a first contact angle of the polishing surface relative to a horizontal reference line relative to the first planar surface; and operating the rotating polishing wheel in accordance with a second set of polishing parameters, different that the first set of polishing parameters, to form a second curved surface at the edge and the second planar surface, the second set of polishing parameters comprising a second set of rotational speeds, a second set of translational speeds and a second contact angle of the polishing surface relative to the horizontal reference line relative to the first planar surface different than the first angle, wherein the first curved surface and the second curved surface cooperate to form the smoothed edge.

2. The method of claim 1, wherein the first set of polishing parameters includes a first rotational speed and a second rotational speed different than the first rotational speed, wherein the first rotational speed is used to polish the first planar surface and the second rotational speed is used to polish the edge.

3. The method of claim 2, wherein the first rotational speed is higher than the second rotational speed.

4. The method of claim 1, wherein the first set of polishing parameters includes a first translational speed and a second translational speed different than the first translational speed, wherein the first translational speed is used to polish the first planar surface and the second translational speed is used to polish the edge.

5. The method of claim 4, wherein the first translational speed is lower than the second translational speed.

6. The method of claim 1, wherein the first angle is smaller than the second angle.

7. The method of claim 1, wherein the first set of polishing parameters or the second set of polishing parameters is adjusted for smoothing an edge of a second part to account for a change in shape of the polishing surface of the polishing wheel.

8. The method of claim 1, wherein the first set of polishing parameters includes a first depth of interference and the second set of polishing parameters includes a second depth of interference, the first depth of interference defining a first distance between the part and a center of the polishing wheel and the second depth of interference defining a second distance between the part and a center of the polishing wheel, wherein the first depth of interference is different than the second depth of interference.

9. An apparatus configured to shape an edge defined by a first planar surface and a second planar surface of a part, the apparatus comprising:

a polishing wheel configured to rotate about a central axis at a plurality of rotational speeds in a first rotational direction and in a second rotational direction opposite the first rotational direction, the polishing wheel having a perimeter with a polishing surface;

and a positioning assembly configured to control the polishing surface to smooth the edge using at least a first pass and second pass, wherein the first pass comprises translating the polishing surface along the first planar surface and the edge in accordance with a first set of polishing parameters, the first set of polishing parameters comprising a first set of rotational speeds, a first set of translational speeds and a first contact angle of the polishing surface relative to a horizontal reference line of the polishing wheel, wherein the second pass comprises translating the polishing surface along the second planar surface and the edge in accordance with a second set of polishing parameters different that the first set of polishing parameters, the second set of polishing parameters comprising a second set of rotational speeds, a second set of translational speeds and a second contact angle of the polishing surface relative to a horizontal reference line of the polishing wheel different than the first angle.

10. The apparatus of claim 9, wherein the polishing surface is configured to remove burrs from the part.

11. The apparatus of claim 9, wherein the first set of polishing parameters includes a first rotational speed and a second rotational speed different than the first rotational speed, wherein the first rotational speed is used to polish the first planar surface and the second rotational speed is used to polish the edge.

12. The apparatus of claim 11, wherein the first rotational speed is higher than the second rotational speed.

13. The apparatus of claim 9, wherein the first set of polishing parameters includes a first translational speed and a second translational speed different than the first translational speed, wherein the first translational speed is used to polish the first planar surface and the second translational speed is used to polish the edge.

14. The apparatus of claim 13, wherein the first translational speed is lower than the second translational speed.

15. The apparatus of claim 9, wherein the first angle is smaller than the second angle.

16. The apparatus of claim 9, further comprising:

a fixture configured to stabilize the part and to reveal the first planar surface, the second planar surface, and the edge of the part.

17. The apparatus of claim 16, wherein the fixture includes a wall that protects a portion of the first planar surface during a shaping operation.

18. The apparatus of claim 9, wherein the polishing wheel includes a nylon brush.

19. A non-transitory computer readable medium storing computer program code executable by a processor for controlling a computer aided manufacturing operation for smoothing an edge of a part defined by a first planar surface and a second planar surface, the computer readable medium comprising:

computer program code for operating a rotating polishing wheel comprising a polishing surface in accordance with a first set of polishing parameters to form a first curved surface at the edge and the first planar surface, the first set of polishing parameters comprising a first set of rotational speeds, a first set of translational speeds and a first contact angle of the polishing surface relative to a horizontal reference line relative to the first planar surface; and computer program code for operating the rotating polishing wheel in accordance with a second set of polishing parameters, different that the first set of polishing parameters, to form a second curved surface at the edge and the second planar surface, the second set of polishing parameters comprising a second set of rotational speeds, a second set of translational speeds and a second contact angle of the polishing surface relative to the horizontal reference line relative to the first planar surface different than the first angle, wherein the first curved surface and the second curved surface cooperate to form the smoothed edge.

20. The non-transitory computer readable medium of claim 19, further comprising:

computer program code for adjusting the first set of polishing parameters or the second set of polishing parameters for smoothing an edge of a second part to account for a change in shape of the polishing surface of the polishing wheel after smoothing the edge of a first part.

21. The non-transitory computer readable medium of claim 19, wherein the first set of polishing parameters includes a first rotational speed and a second rotational speed, wherein the first rotational speed is used to polish the first planar surface and the second rotational speed is used to polish the edge.

22. The non-transitory computer readable medium of claim 21, wherein the first rotational speed is higher than the second rotational speed.

23. The non-transitory computer readable medium of claim 19, wherein the first set of polishing parameters includes a first translational speed and a second translational speed, wherein the first translational speed is used to polish the first planar surface and the second translational speed is used to polish the edge.

24. The non-transitory computer readable medium of claim 19, wherein the first angle is smaller than the second angle.

* * * * *